US006346028B1

(12) United States Patent
Fildan et al.

(10) Patent No.: US 6,346,028 B1
(45) Date of Patent: Feb. 12, 2002

(54) SPOON UNDERWIRE

(75) Inventors: Gerhard Fildan, Vienna; Karl Wanzenböck, Leobersdorf, both of (AT)

(73) Assignee: Fildan Accessories Corporation, Humble, TX (US)

( * ) Notice: Subject to any disclaimer, the term of this patent is extended or adjusted under 35 U.S.C. 154(b) by 0 days.

(21) Appl. No.: 09/837,869

(22) Filed: Apr. 18, 2001

(51) Int. Cl.[7] ..... A41C 3/00
(52) U.S. Cl. ..... 450/41; 450/52; 450/51
(58) Field of Search ..... 450/41–52, 80; 2/255–264

(56) References Cited

U.S. PATENT DOCUMENTS 2,731,640 A * 1/1956 Gaison ..... 450/41
2,923,300 A * 2/1960 Ots ..... 450/41
3,209,756 A * 10/1965 Rowell ..... 450/41
3,312,223 A * 4/1967 Wilson ..... 450/41
4,245,644 A * 1/1981 Evans ..... 450/57 X
5,730,641 A * 3/1998 Brown ..... 450/41

* cited by examiner

*Primary Examiner*—Gloria M. Hale
(74) *Attorney, Agent, or Firm*—Herbert Dubno

(57) ABSTRACT

An underwire having a spoon-shaped formation and capable of swiveling with respect to the tail of the underwire is provided in a brassiere-type garment to lie with the spoon along the outer side of the breast and to conform to the junction between the breast and the thorax at the outer side.

15 Claims, 7 Drawing Sheets

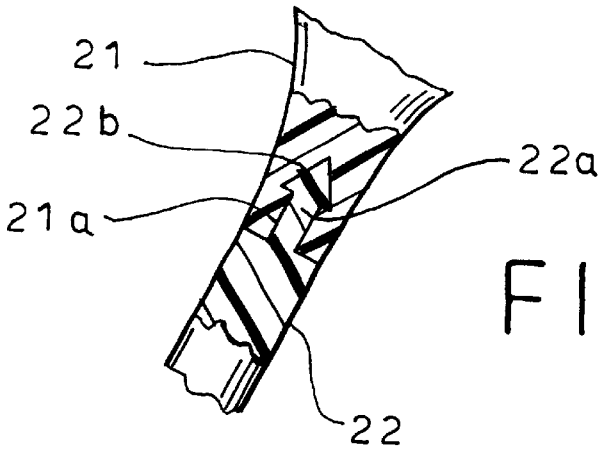
FIG. 2A
FIG. 3
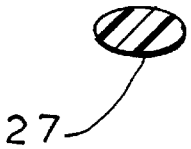
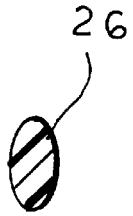
FIG. 5
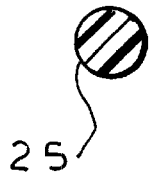
FIG. 4
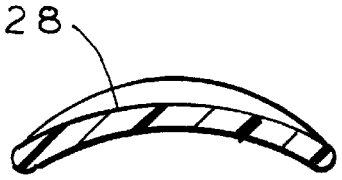
FIG. 6
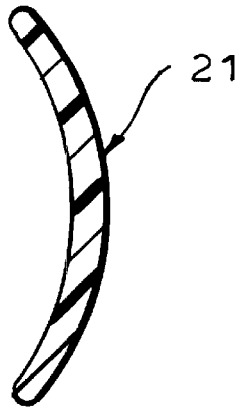
FIG. 7

SPOON UNDERWIRE

FIELD OF THE INVENTION

Our present invention relates to a spoon underwire for brassiere-type garments and, more particularly, to an underwire having a spoon end capable of swiveling relative to the tail of the underwire so that while the tail which extends below the breast lies in the plane of the underwire, a double-curved spoon formation at one end thereof self-adjusts to the junction of an outer part of the breast and the torso. The invention also relates to a brassiere having such spoon-type underwires.

BACKGROUND OF THE INVENTION

Underwires are provided along the underside of brassiere cups to maintain the shape of the cup and to impart a predetermined configuration to the cup at its junction with the remainder of the brassiere, generally referred to as a frame. The use of underwires is also possible in brassiere-like garments such as swimsuits, other items of lingerie, preformed with cups, like camisoles and any outer garments which are formed with cups and generally are suspended by straps from the shoulders of the wearer. Reference here to brassieres, therefore, is intended to include such other brassiere-type garments as well.

Underwires of many types have been used. The underwire is generally received in a pocket formed along the underside of the cup and can be of uniform cross section over its length and can be provided at its tip with slight enlargements which can assist in anchoring the underwire in the garment and which prevent the underwire from poking through the garment, in use, when packed in a suitcase, for example, or when the garment is washed.

One of the problems with conventional underwires, whether these are of round cross section, flattened cross section or partly angular and partly rounded and whether the underwire is composed of metal, plastic or plastic-coated metal is that the underwire frequently does not fit well against the thorax and the junction between the breast and the thorax and thus may render the garment uncomfortable. In addition conventional underwire designs do not enable the garment to follow movements of the body of the wearer and thus, while imparting a certain firmness to the supporting structure of the brassiere, do not provide for the flexibility of the garment which is necessary for comfort. An earlier underwire configuration in which an armature is embedded in a surround is described in International Publication No. WO 99/48392 published Sep. 30, 1999.

OBJECTS OF THE INVENTION

It is, therefore, the principal object of the present invention to provide an improved underwire for brassieres and brassiere-type garments whereby drawbacks of earlier underwire systems are avoided.

Another object of this invention is to provide an underwire and an underwire garment which has improved comfort, a greater capacity to follow the movements of the body of the wearer, and a reduced tendency to press against the body of the wearer in a discomforting manner.

SUMMARY OF THE INVENTION

These objects and others which will become apparent hereinafter are attained, in accordance with the invention with an underwire which has, at one end a spoon shape with a double curvature, merging into a tail which extends arcuately beneath the base of the breast, the spoon formation continuing the curvature of the tail in a plane of the underwire and being curved at least in part away from the breast. According to a key feature of the invention, the spoon formation can swivel relative to the tail portion and thereby self-adjust to the particular configuration of the breast.

The tail can, in accordance with the present invention, have an oval or round cross section but preferably transitions between a circular cross section close to the spoon formation and an oval configuration more distal therefrom. The tail can, moreover, taper monotonically from the spoon formation toward its free end which is preferably rounded. It has been found to be advantageous, moreover, to form the tail with annular grooves, notches, transverse or longitudinal ribs which reduce the cross sectional area of the tail at least at some regions between the spoon formation and the free end and thus increase the flexion of the wire about an axis running through the center of the tail and transverse to or in the plane of this axis.

For the purposes of the present invention, it is convenient to think of the underwire as having an underwire axis running from the free end of the tail to the tip of the spoon formation and which lies in a plane and has the desired curvature of the base of the cup. This axis is referred to herein as the wire axis or the main axis and the "plane" of the underwire is the plane of this axis. In sections transverse to this axis, the tail may have cross sections which are approximately circular close to the spoon formation transitioning through oval cross sections at intermediate points along the length of the tail to a flattened oval cross section toward the free end or tip of the tail.

In planes transverse to this axis running from the transition with the tail, the spoon can have a curvature which is at least partly concave away from the interior of the arc, i.e. away from the breast, especially where the respective portion of the spoon is intended to lie along the thorax of the wearer at the junction of the outer side of the breast therewith. The curvature of the spoon formation can conform to the shape of the breast which is convex to the junction and concave at the junction so that in a cross section the spoon has a flattened S shape. Since the spoon curves longitudinally along the arc of the axis, i.e. around the breast, and curves transversely thereto as well, it is referred to as having double curvature.

The coupling between the tail and the spoon allows the spoon to swivel relative to the tail about the aforementioned main or wire axis. As a result, the tail or the spoon can twist out of the plane of the wire to follow the contour of the body and the movement thereof, greatly increasing the comfort of an underwire garment in which the underwire is incorporated.

The invention also includes a brassiere or brassiere-like garment provided with the underwire of the invention which can be held in a pocket of the garment.

BRIEF DESCRIPTION OF THE DRAWING

The above and other objects, features, and advantages will become more readily apparent from the following description, reference being made to the accompanying drawing in which:

FIG. 2A is a detail section showing the swivel;

FIG. 3 is a cross sectional view taken along the line III—III of FIG. 2;

FIG. 4 is a cross sectional view taken along the line IV—IV of FIG. 2;

FIG. 5 is a cross sectional view taken along the line V—V of FIG. 2;

FIG. 6 is a cross sectional view taken along the line VI—VI of FIG. 2;

FIG. 7 is a longitudinal section through the spoon formation taken along the line VII—VII of FIG. 2;

SPECIFIC DESCRIPTION

We have discovered that it is highly advisable to provide a swiveling action between a spoon and a tail in an underwire so that the spoon can accommodate itself to the actual shape of the breast at its junction with the thorax adjacent the respective armpit of the wearer.

The underwire which is capable of swiveling can have a swivelable spoon-shaped formation on one end so that the convex portion of that spoon can lie at the junction between the base of the breast and torso of the wearer between the breast and the armpit and thus in the cavity which is there formed. Since the chest of the wearer is mobile in practice, this swiveling action follows the movement of the pectoralis major muscle in this region and does not resist the flexing and relaxation of the muscle while maintaining the support for the breast.

Figure 1:
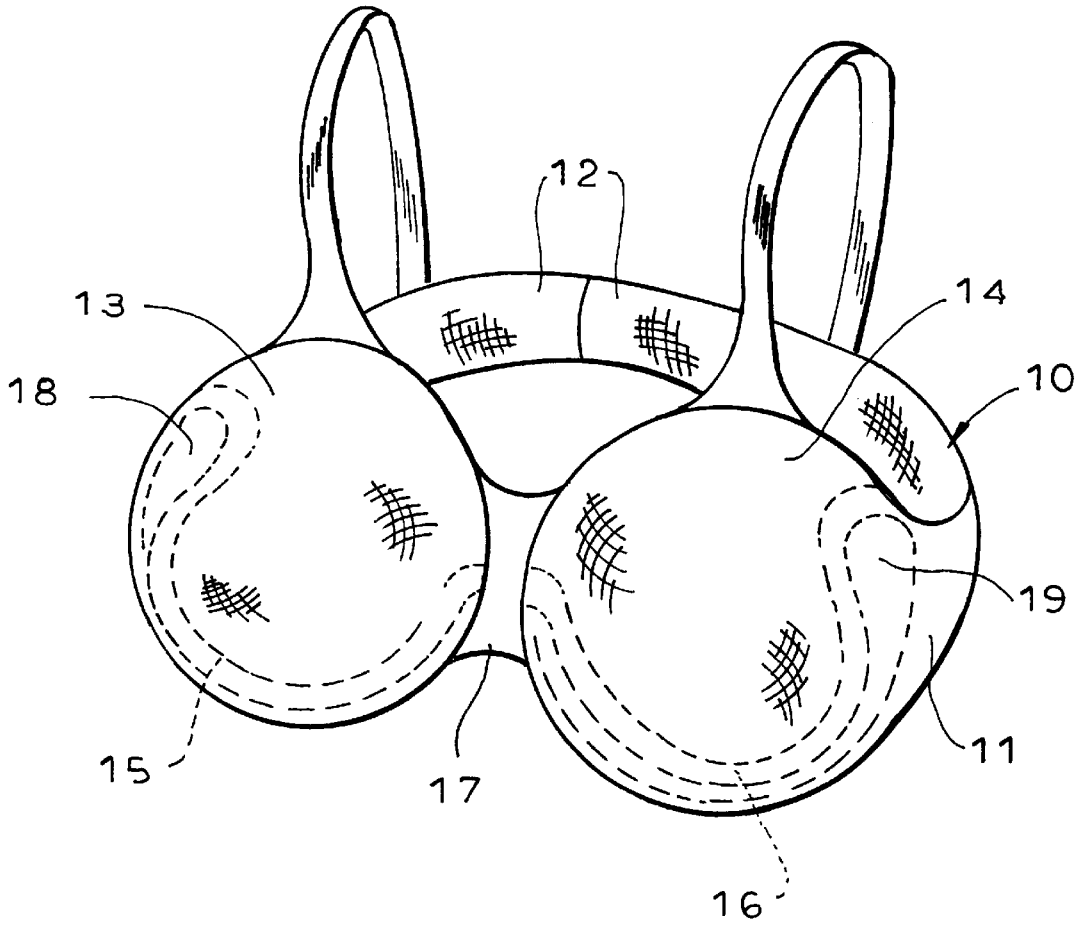
FIG. 1 is a perspective view of a brassiere provided with the underwire of the invention.

As shown in FIG. 1, for example, a brassiere 10 can comprise a brassiere base 11 having a back strap 12 and a pair of cups 13 and 14 into which are incorporated, along the lower edge, respective underwires 15 and 16 in stitched pockets of the brassiere.

The outer portions of the wires rise above the inner portions, i.e. the portions that terminate at the midsection 17 of the garment and are provided with spoon formations 18 and 19.

As can be seen from FIG. 1 as well, the spoon formations 18 and 19 lie against the thorax of the wearer at the junction of the breast with the thorax at the outer portions of the breast reaching into the upper hemisphere.

Figure 2:
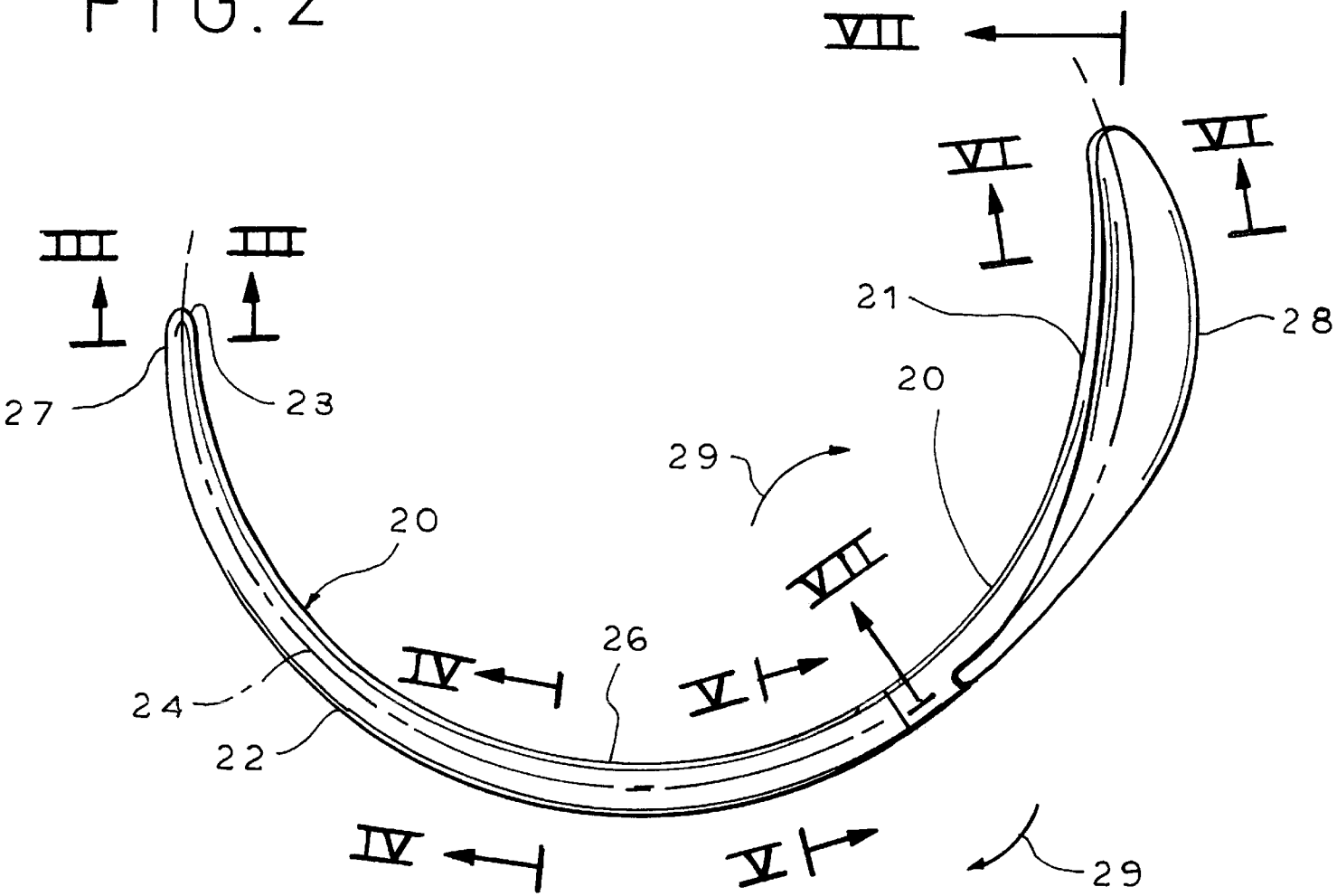
FIG. 2 is a perspective view of the underwire drawn to a much larger scale than that of FIG. 1.

A more detailed showing of one such underwire, which can be composed of a synthetic resin material such as a polyamide or polycarbonate or possibly a softer synthetic resin is found in FIG. 2. That underwire 20 has a spoon-shaped formation 21 at one end and a tail 22 tapering to the opposite end 23 at which it is rounded. The axis 24 of that underwire lies in a plane and conforms to an arc which may be the typical shape of the base of the breast.

The cross section of the wire may vary along the tail from a circular cross section at 25 as shown in FIG. 5 to a more elliptical or oval cross section in the plane at 26 and to a somewhat oval cross section near the tip at 27 which may have its major axis perpendicular to the plane.

The spoon is doubly curved. Firstly it is curved along the arc of the axis 24 to continue that arc and is thus concave toward the breast which is convex and thus matches the curvature.

Secondly it is curved in planes perpendicular to the axis, i.e. in the sectional plane of FIG. 6 where at 28 it has a flattened S shaped curvature. The longitudinal curvature has been shown in FIG. 7.

As can be seen in FIG. 2A, the wire 22 can have a pin, plug or other male formation 22*a* which is held in a hole 21*a* of the spoon 21 and a head 22*b* engaged behind a shoulder of the hole to enable the wire to be plugged into the spoon and the spoon to swivel relative to the wire.

Figure 8:
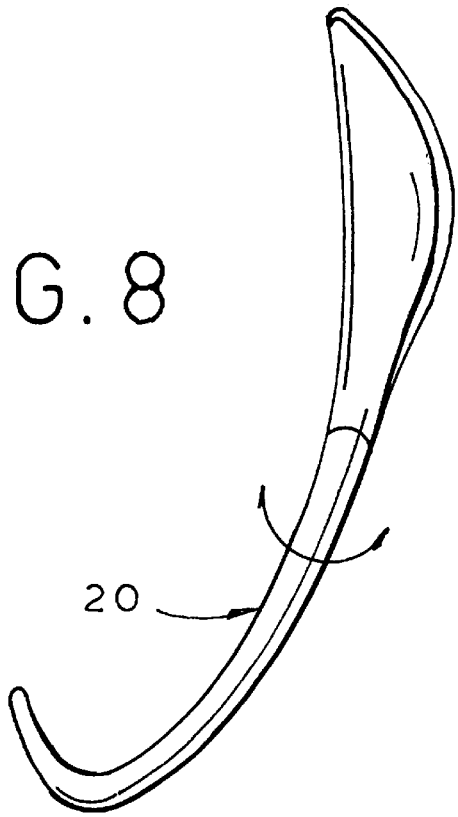
FIG. 8 is a perspective view showing the swivel action for the underwire.
Figure 9:
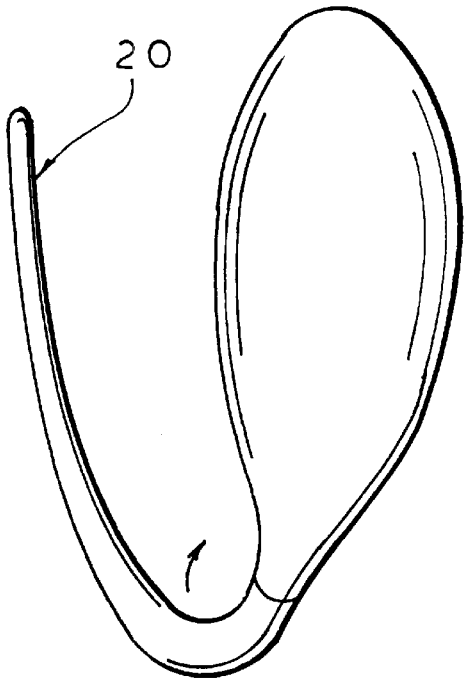
FIG. 9 is a view similar to FIG. 8 showing a different degree of swiveling.

In practice, therefore, the spoon-shaped formation 21 can swivel as represented by arrows 29 in FIG. 2 to assume different orientations as represented diagrammatically in FIGS. 8 and 9.

The relaxed orientation of the spoon may vary as well. In FIG. 11, for example, the spoon-shaped formation is shown to be symmetrical with the axis whereas in FIG. 10 it is twisted to one side in a manner similar to that shown in FIG. 10. However, the spoons 31 of FIGS. 10 and 11 have tails 32 which are formed with ribs 33 enabling greater flexure than the solid section of the tail 22 of the underwire in FIG. 2.

Figure 10:
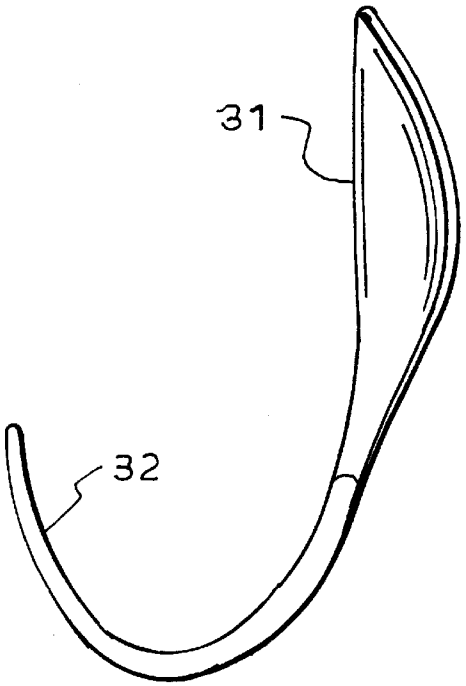
FIG. 10 is a perspective view of an underwire according to another embodiment of the invention, in one position of the swivelable spoon.
Figure 12:
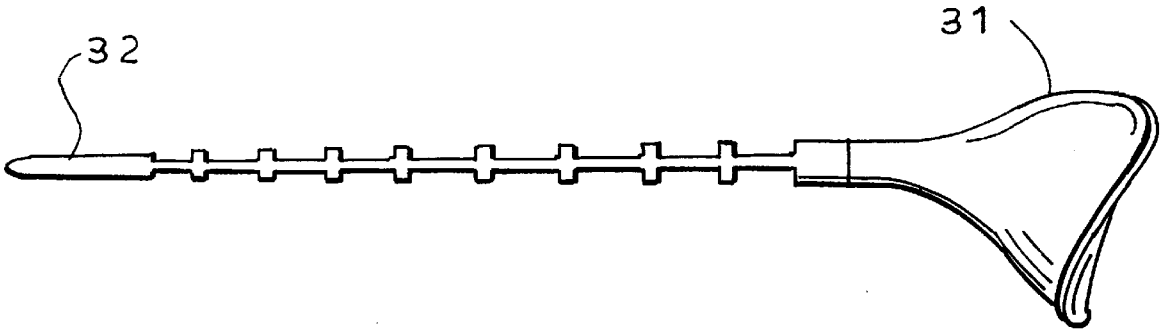
FIG. 12 is a view from above showing a wire similar to that of FIG. 11 for a brassiere for a large breasted individual.
Figure 11:
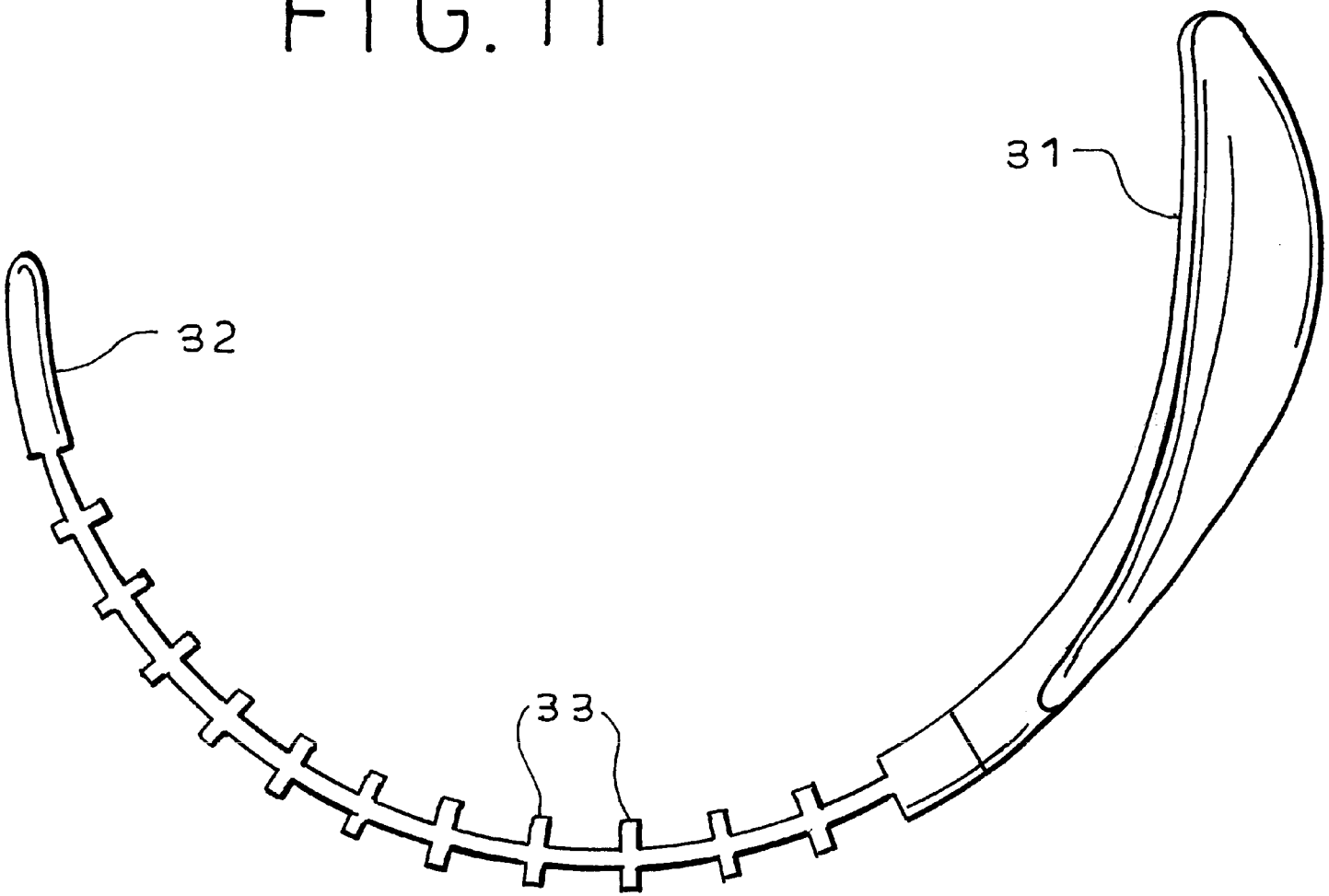
FIG. 11 is a view of the underwire of FIG. 10 in a relaxed state with the swivelable spoon centered on the main axis.
Figure 13:
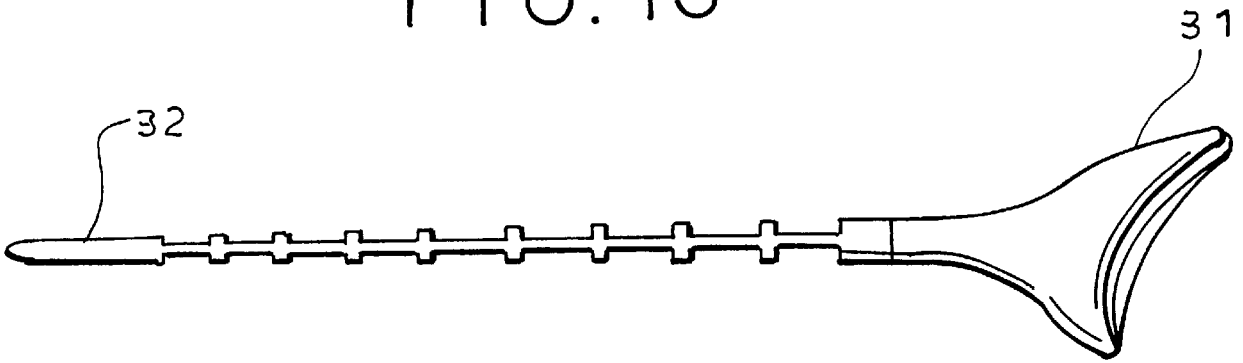
FIG. 13 is a view similar to FIG. 12 for an average breast size.
Figure 14:
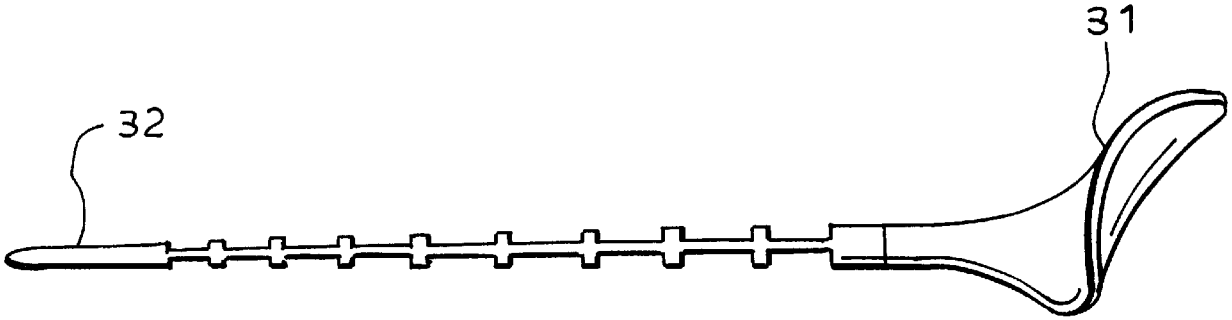
FIG. 14 is a view similar to FIG. 12 but for an individual with a small breast size.

Utilizing the tail 32 in FIGS. 10 and 11, the underwire can accommodate itself to three different female figures and their relationships between breast size and thorax width. The positions of the spoon in a normal relationship shown in FIG. 13, for example, where the breast size and the chest width are in an average proportion and for smaller breast sizes in conjunction with smaller chest widths (FIG. 14) and larger breast sizes and larger breast widths (FIG. 12) have been shown. With a relationship in which the breast size is larger but the chest width is small, the spoon-shaped formation 31 can swivel so that it is twisted out of the plane whereas with a small breast size and wide chest, the spoon-shaped formation 34 (FIG. 14) can swivel so that it extends somewhat into the plane. In all cases, of course, because of the possibility of the underwire to flex and twist, the underwire adjusts to the diameter and depth of the breast. For the left and right breasts, of course, the spoons will be molded of different curvatures but can receive the same wire tail shape and each spoon can be used with any size wire tail, depending upon breast size. The spoon can be composed of a softer material than the wire. Preferably both the wire and the spoon are molded of nylon.

We claim:

1. A cup support for a brassiere-type garment comprising a one-piece elongated underwire of a resilient synthetic resin and extending in a continuous arc from one end to an opposite end, said underwire being formed at said one end with an elongated spoon-shaped formation curved longitudinally along said arc and with a tail which is more slender than said spoon-shaped formation and runs along said arc from said spoon-shaped formation to said opposite end, said underwire having an underwire axis extending along said arc in an underwire plane in a relaxed condition of said underwire, said spoon-shaped formation having cross sections in planes perpendicular to said axis which are curved so that said spoon-shaped formation conforms generally to a junction between the outer chest of a wearer and a base of a breast of the wearer, said spoon-shaped formation swivelable relative to said tail.

2. The cup support defined in claim 1 wherein said tail tapers toward said other end.

3. The cup support defined in claim 2 wherein said tail is of generally oval cross section over at least part of a length thereof.

4. The cup support defined in claim 3 wherein said tail has a circular cross section proximal to said spoon-shaped formation.

5. The cup support defined in claim 1 wherein said tail is formed with spaced apart ribs over at least a part of a length thereof.

6. The cup support defined in claim 1 wherein said spoon-shaped formation is generally of a flattened-S cross section in said planes perpendicular to said axis and is composed of a material which is softer than that of said tail.

7. A brassiere-type garment comprising a garment base adapted to lie along a thorax of a wearer and a pair of breast cups affixed to said base, each of said cups being provided with a respective cup support below the respective cup, each of said cup supports comprising a one-piece elongated underwire of a resilient synthetic resin and extending in a continuous arc from one end to an opposite end, each said underwire being formed at said one end with an elongated spoon-shaped formation curved longitudinally along said arc and with a tail which is more slender than said spoon-shaped formation and runs along said arc from said spoon-shaped formation to said opposite end, each said underwire having an underwire axis extending along said arc in an underwire plane in a relaxed condition of the respective underwire, each said spoon-shaped formation having cross sections in planes perpendicular to the respective axis which are curved so that said spoon-shaped formation conforms generally to a junction between an outer portion of the chest of the wearer and a base of a breast of the wearer, each said spoon-shaped formations being connected to the respective tail by a swivel enabling the spoon-shaped formation to swivel about relative to the respective tail.

8. The garment defined claim 7 wherein each of said cups is formed with a pocket receiving the respective underwire.

9. The garment defined in claim 8 wherein the tail of each of said underwires tapers toward the respective other end thereof.

10. The garment defined in claim 9 wherein each of said tails is of generally oval cross section over at least part of a length thereof.

11. The garment defined in claim 10 wherein each of said tails has a circular cross section proximal to the respective spoon-shaped formation.

12. The garment defined in claim 8 wherein each of said tails is formed with spaced apart ribs over at least a part of a length thereof.

13. The garment defined in claim 8 wherein each of said spoon-shaped formations is generally of a flattened-S cross section in said planes perpendicular to the respective axis.

14. The garment defined in claim 8 wherein each of said spoon-shaped formations is composed of a material softer than the material of the respective tail.

15. The garment defined in claim 8 wherein each swivel is a pin on the respective tail received in a hole in the respective spoon-shaped formation.

* * * * *